US007025383B2

(12) United States Patent
Canale

(10) Patent No.: US 7,025,383 B2
(45) Date of Patent: Apr. 11, 2006

(54) TELESCOPIC EXTENSION FOR AN ELECTRIC HOUSEHOLD APPLIANCE

(75) Inventor: Giuseppe Canale, Gorla Minore (IT)

(73) Assignee: OMEC S.p.A., Gorla Minore (IT)

( * ) Notice: Subject to any disclaimer, the term of this patent is extended or adjusted under 35 U.S.C. 154(b) by 0 days.

(21) Appl. No.: 10/415,959

(22) PCT Filed: Oct. 23, 2001

(86) PCT No.: PCT/EP01/12396

§ 371 (c)(1),
(2), (4) Date: Sep. 23, 2003

(87) PCT Pub. No.: WO02/38026

PCT Pub. Date: May 16, 2002

(65) Prior Publication Data

US 2004/0051302 A1 Mar. 18, 2004

(30) Foreign Application Priority Data

Nov. 7, 2000 (IT) ..... MI20000626 U

(51) Int. Cl.
*A47L 9/24* (2006.01)

(52) U.S. Cl. ..... 285/7; 285/302; 285/303

(58) Field of Classification Search ..... 285/7, 285/302, 303

See application file for complete search history.

(56) References Cited

U.S. PATENT DOCUMENTS

| | | | | |
|---|---|---|---|---|
| 3,049,367 | A * | 8/1962 | Lashta | 285/7 |
| 3,351,363 | A * | 11/1967 | Downey et al. | 285/303 |
| 5,332,266 | A | 7/1994 | Canale | |
| 5,692,782 | A * | 12/1997 | Fischer | 285/7 |
| 5,954,370 | A * | 9/1999 | Pietersen | 285/7 |
| 6,148,474 | A * | 11/2000 | Ohara et al. | 15/377 |
| 6,431,607 | B1 * | 8/2002 | Kittelmann et al. | 285/7 |
| 6,435,754 | B1 | 8/2002 | Canale | |
| 6,474,696 | B1 | 11/2002 | Canale | |
| 6,494,492 | B1 * | 12/2002 | Ha | 285/7 |
| 6,565,123 | B1 * | 5/2003 | Schiemann et al. | 285/7 |
| 6,832,784 | B1 * | 12/2004 | Chen | 285/7 |

FOREIGN PATENT DOCUMENTS

| | | |
|---|---|---|
| EP | 0 520 534 B1 | 12/1992 |
| EP | 0 937 435 A | 8/1999 |
| EP | 1 033 103 A | 9/2000 |
| EP | 1 092 383 A | 4/2001 |
| WO | 98/56289 | 12/1998 |

* cited by examiner

*Primary Examiner*—James M. Hewitt
(74) *Attorney, Agent, or Firm*—Nixon & Vanderhye, P.C.

(57) ABSTRACT

A telescopic extension (1) comprises an inner tube (2), an outer tube (3) and a sleeve (4) in which a constraining element (21) and a thrust slider (30) are movably supported; the constraining element (21) is capable of making integral the inner tube (2) and the outer tube (3) and the thrust slider (30) is connected to an actuating element (40) and is engaged with the constraining element (21) under the action of a spring (31); the constraining element (21) consists of a projection of an elastic tongue (16) having one end (19) formed as one piece with the sleeve (4).

8 Claims, 6 Drawing Sheets

TELESCOPIC EXTENSION FOR AN ELECTRIC HOUSEHOLD APPLIANCE

This application is the US national phase of international application PCT/EP01/12396 filed 23 Oct. 2001, which designated the US.

BACKGROUND

I. Field of the Invention

The present invention relates to a telescopic extension for an electric household appliance.

II. Related Art and Other Considerations

EP-B1-0 520 534 discloses a telescopic extension for a vacuum cleaner, comprising an inner tube and an outer tube sealingly slidable one inside the other, a sleeve, a means for constraining the inner tube and outer tube, a thrust slider and an actuating pushbutton.

The inner tube is provided with a row of recesses having a predefined shape and the outer tube is provided with an end tubular portion with a flared shape which is formed as one piece therewith and inside which the sleeve is fastened.

The constraining means consists of a cylinder piece integral with a plate provided with a pin. By means of the pin and the plate, the cylinder piece is rotatably supported in a hollow seat of the sleeve. The seat has, formed in it, a slit by means of which the cylinder piece is able to engage with a recess of the inner tube and disengage from the recess.

In this telescopic extension, the thrust slider is operationally connected to the actuating pushbutton, is slidably supported inside the seat of the sleeve and is subject to the action of resilient means.

The resilient means cause the thrust slider to engage with the plate integral with the cylinder piece to force the latter into the recess of the inner tube and lock the inner tube inside the outer tube. As a result, the extension assumes a predefined length.

In order to adjust the length of the extension, the actuating pushbutton is pushed manually against the action of the resilient means so that the thrust slider is able to disengage from the plate and leave the cylinder piece free to come out of the recess of the inner tube, releasing the inner tube from the outer tube. By means of sliding of the inner tube inside the outer tube, the extension assumes the desired length.

In order to assemble the extension, the sleeve is fitted onto the inner tube and the constraining means, the slider/pushbutton assembly and the resilient means are pre-mounted in the hollow seat of the sleeve. Then, the inner tube is mounted inside the outer tube and the sleeve is inserted into the end tubular portion, centred with respect thereto, passing the slider/pushbutton assembly through an end opening of the outer tube.

The object of the present invention is to improve the abovementioned extension, reducing the number of components and making assembly easier.

SUMMARY

The present invention relates to a telescopic extension for an electric household appliance, comprising:

a) an inner tube and an outer tube slidable one inside the other, b) a sleeve fastened to said outer tube, c) a constraining means capable of making integral said inner tube and said outer tube, d) a thrust slider which can be engaged with said constraining means under the action of resilient means, and e) actuating means operationally connected to said thrust slider, f) said inner tube being provided with a row of recesses having a predefined shape, g) said sleeve being arranged between said inner tube and said outer tube, h) said constraining means and said thrust slider being movably supported by said sleeve, i) said thrust slider acting on said constraining means under the action of said resilient means to force said constraining means into a recess of said inner tube and lock said inner tube with respect to said outer tube, j) said actuating means being capable of disengaging said thrust slider from said constraining means to leave said constraining means free to move radially and come out of said recess, releasing said inner tube from said outer tube and allowing said inner tube to slide with respect to said outer tube in order to adjust the length of said extension, k) said constraining means having an appendix, characterized in that l) said appendix consists of a resilient tongue having one end formed as one piece with said sleeve, said resilient tongue being radially movable with respect to said sleeve, m) said constraining means consists of a projection on said resilient tongue, and n) said thrust slider can be engaged with said resilient tongue to force said projection into a recess of said inner tube and thus lock said inner and outer tubes and can be disengaged from said resilient tongue to allow said projection to come out of said recess of said inner tube and thus release said inner and outer tubes.

Preferably, said sleeve has a longitudinal cavity able to house said thrust slider and said resilient means.

Advantageously, said longitudinal cavity has an opening inside which said resilient tongue is located, said end of said resilient tongue being formed as one piece with a wall of said longitudinal cavity.

Preferably, said sleeve has an internal longitudinal boss which is located underneath said longitudinal cavity and said inner tube has a longitudinal groove with which said internal longitudinal boss of said sleeve is coupled in order to centre said sleeve with respect to said inner tube.

Preferably, said longitudinal groove of said inner tube has a bottom wall in which said recesses are present.

Advantageously, said outer tube has a lateral opening which extends as far as one end thereof and said sleeve has an external longitudinal relief which engages with said lateral opening to couple said outer tube with said sleeve and centre said outer tube with respect to said sleeve.

Preferably, said sleeve is provided with a collar against which said end of said outer tube comes into contact, said collar and said external relief having a thickness substantially equal to that of said outer tube so that it remains flush with said collar and said external relief.

Advantageously, said thrust slider is provided with an upper head able to be inserted by means of pressure into a niche in said actuating means.

Preferably, said sleeve, said resilient tongue and said projection are made of plastic material.

Advantageously, said outer tube has a cross-section with a substantially constant diameter.

The telescopic projection according to the invention has the advantage that it is compact, low-cost and simple to assemble.

BRIEF DESCRIPTION OF THE DRAWINGS

Characteristic features and advantages of the invention will now be illustrated with reference to an embodiment shown by way of a non-limiting example in the accompanying drawings, in which.

DETAILED DESCRIPTION

Figure 1:
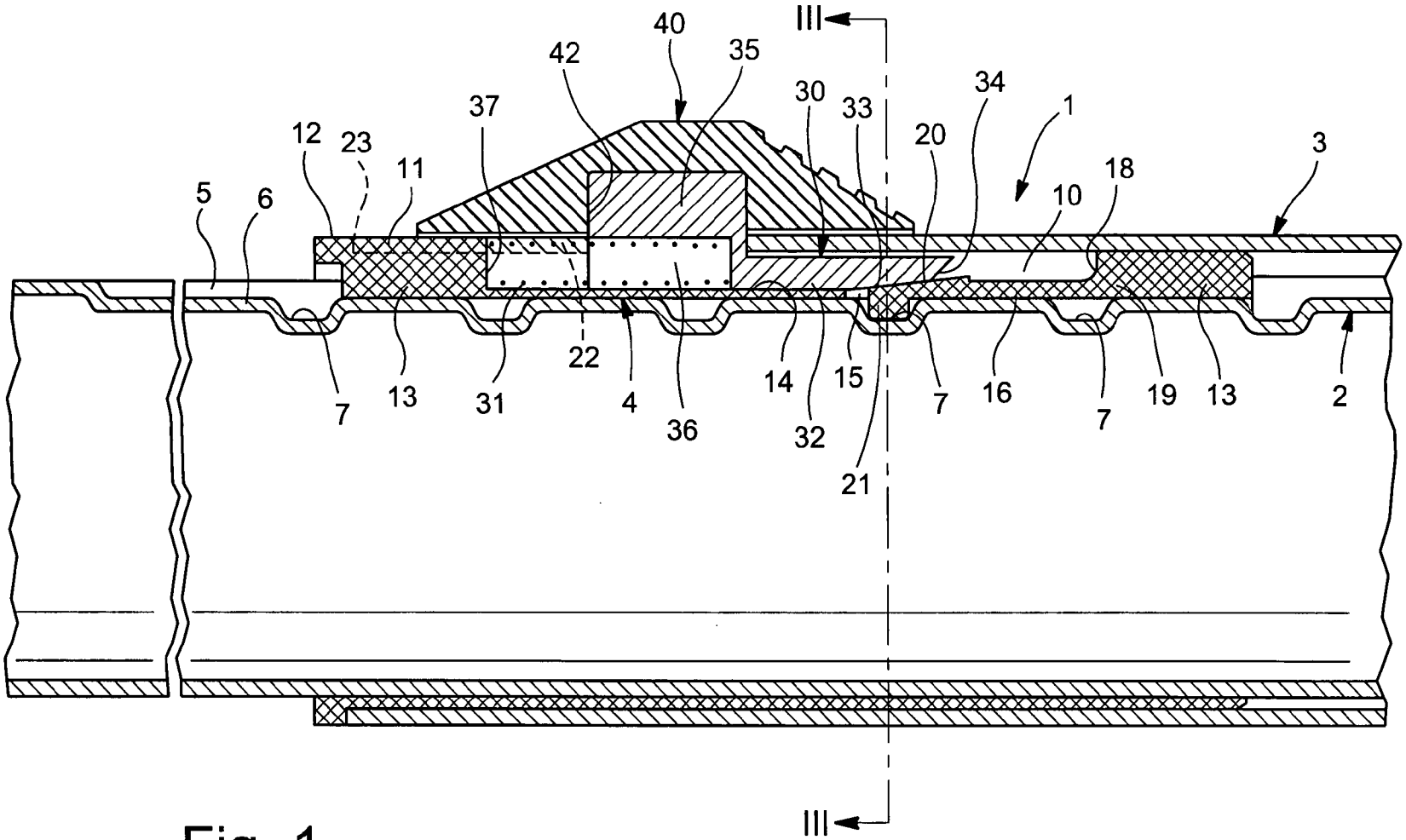
FIG. 1 is a partial, longitudinal sectional view of a telescopic extension for an electric household appliance according to the invention, in the locked condition.
Figure 2:
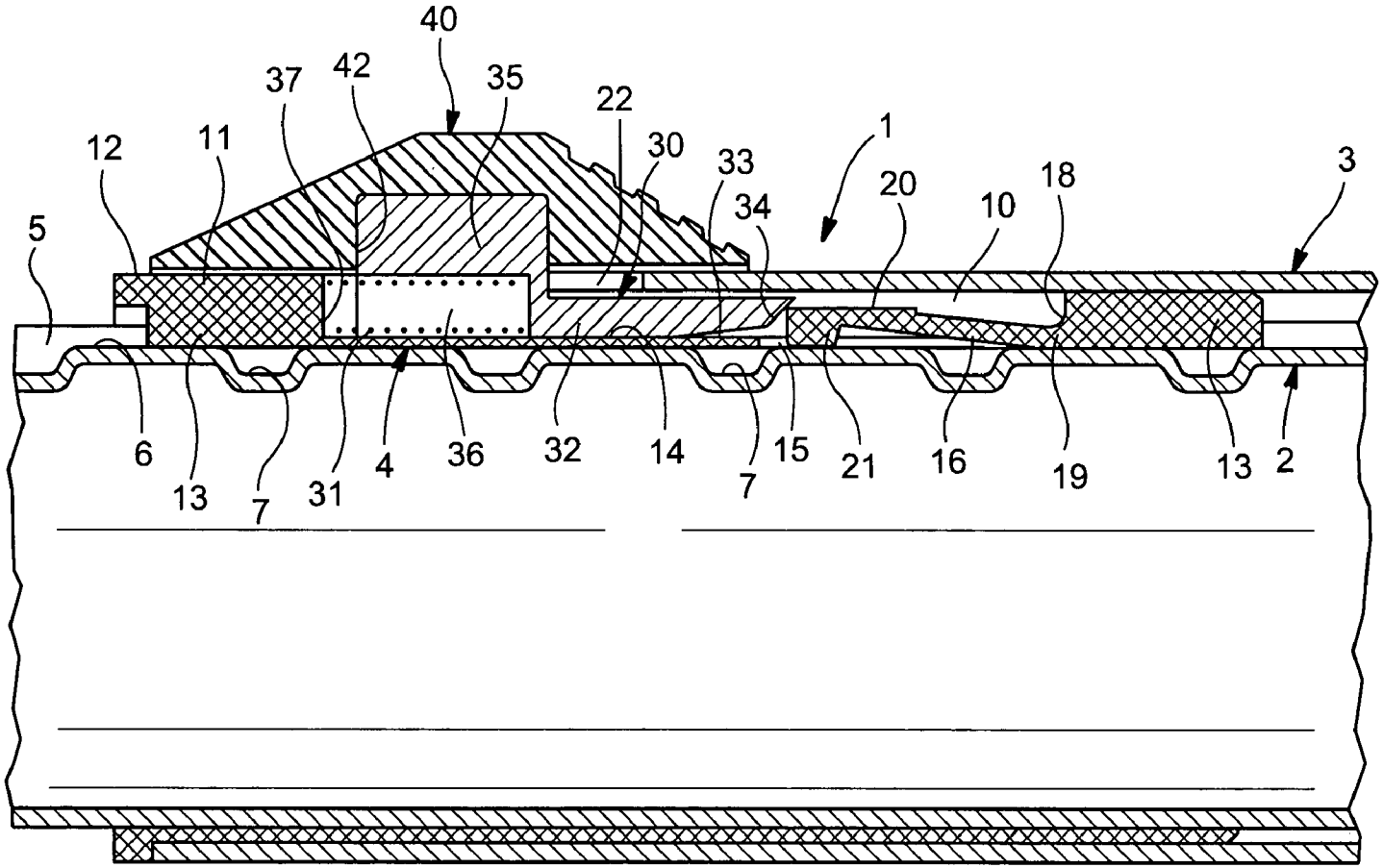
FIG. 2 shows the extension according to FIG. 1 in the unlocked condition.
Figure 3:
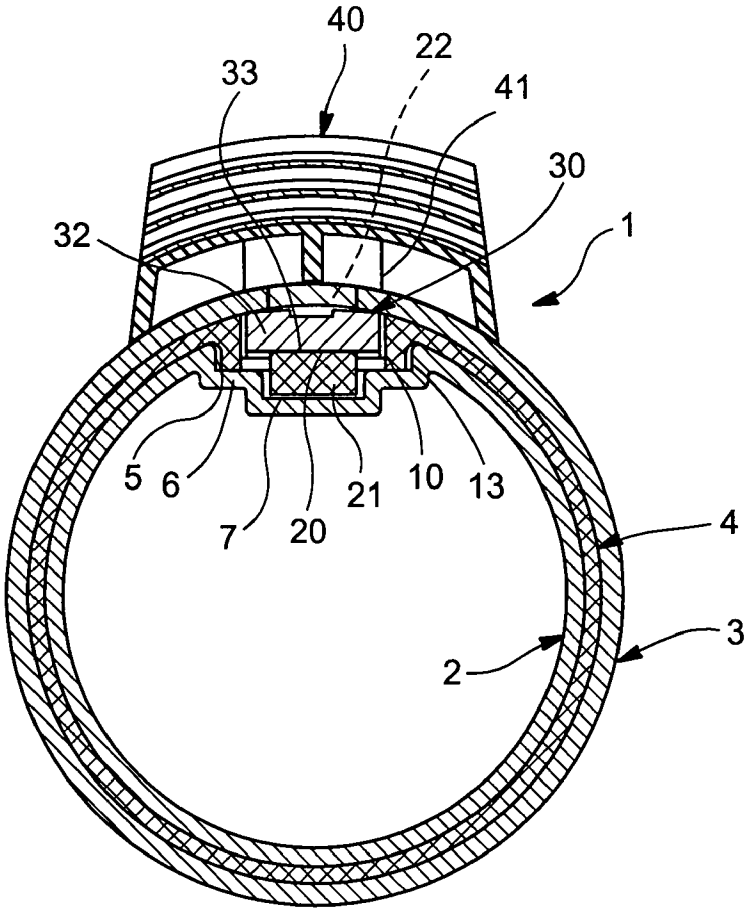
FIG. 3 is a cross-sectional view taken along the plane III—III in FIG. 1.

FIGS. 1, 2 and 3 show a telescopic extension 1 for an electric household appliance, such as a vacuum cleaner. The extension 1 comprises an inner tube 2, an outer tube 3 and a sleeve 4 arranged between the inner tube and the outer tube.

The inner tube 2 and outer tube 3 are sealingly slidable one inside the other. A sealing gasket arranged between inner tube and outer tube is not shown.

The inner tube 2 has a longitudinal groove 5, with a substantially parallelepiped shape, having a bottom wall 6 (FIG. 4) in which a row of recesses 7 with a partially cylindrical shape is formed.

Figure 8:
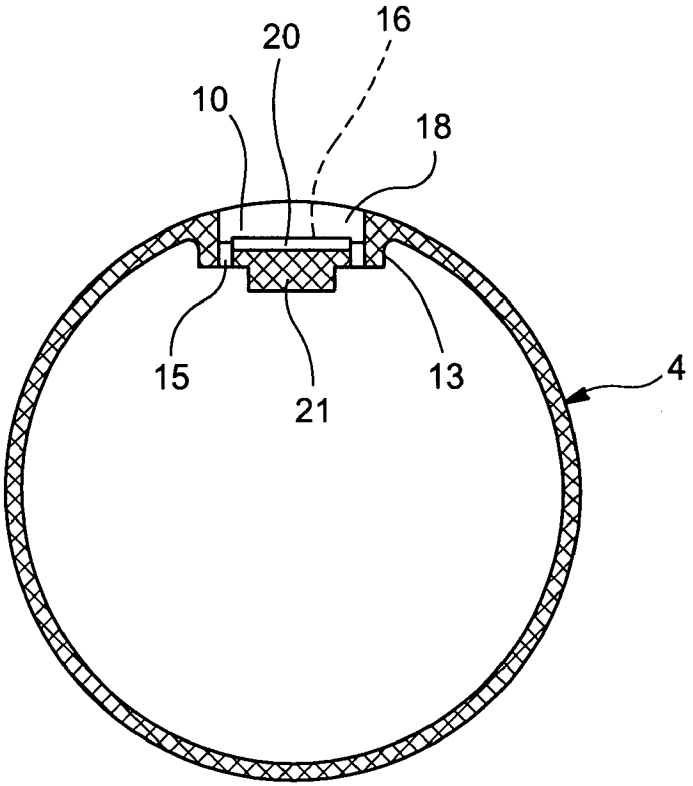
FIG. 8 is a cross-sectional view taken along the plane VIII—VIII in FIG. 7.
Figure 6:
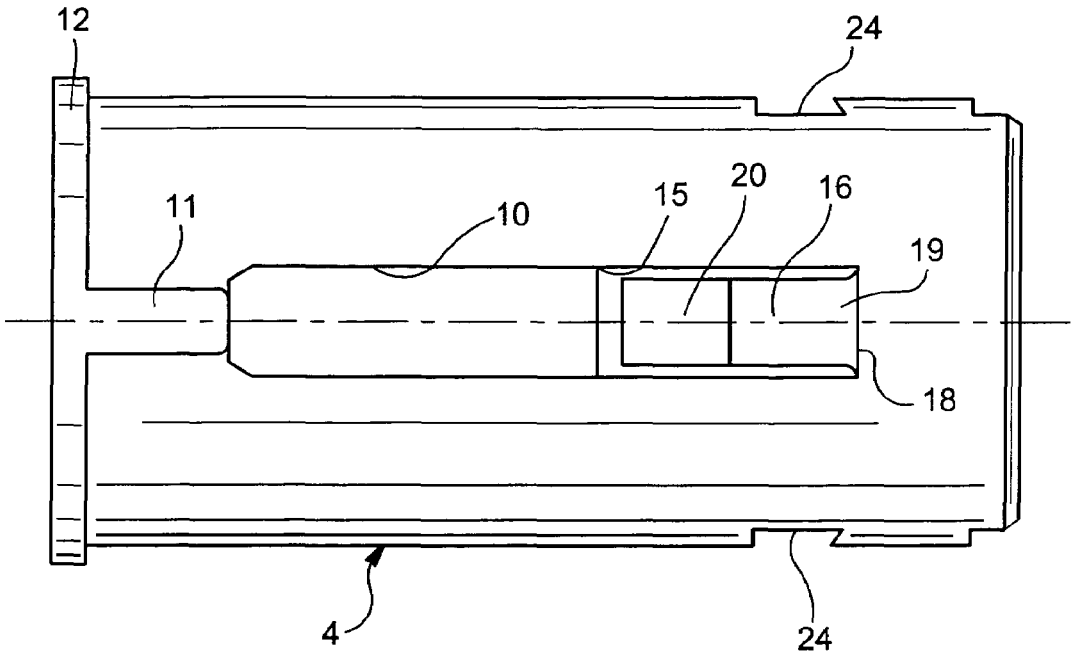
FIG. 6 is a top view of the sleeve of the extension of FIG. 1.
Figure 7:
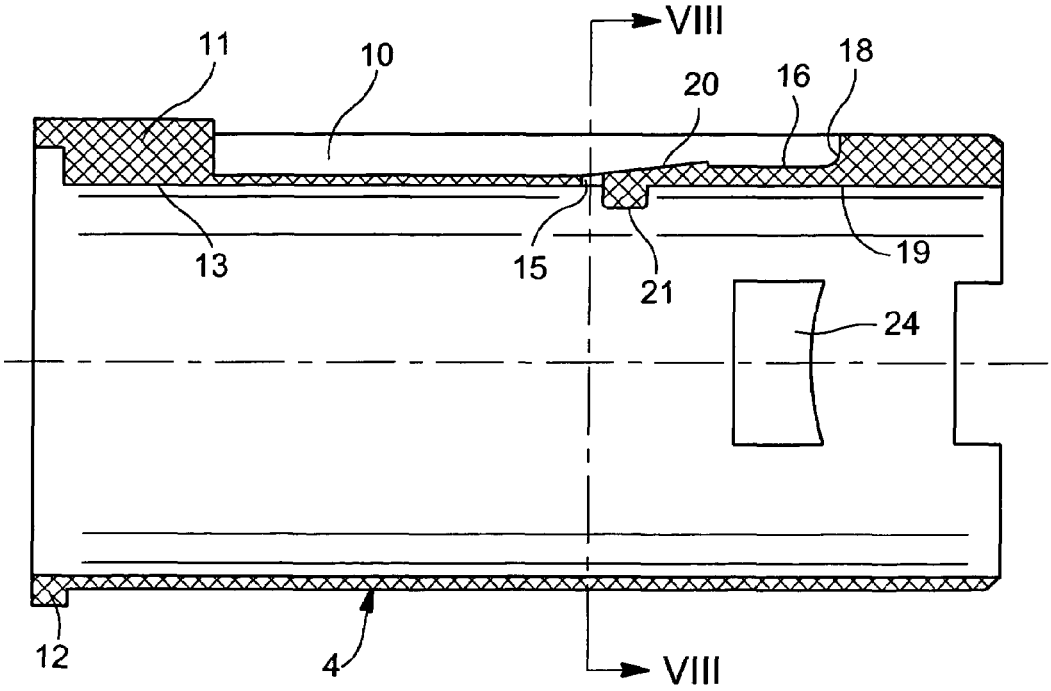
FIG. 7 is a longitudinal sectional view of the sleeve of FIG. 6.
Figure 9:
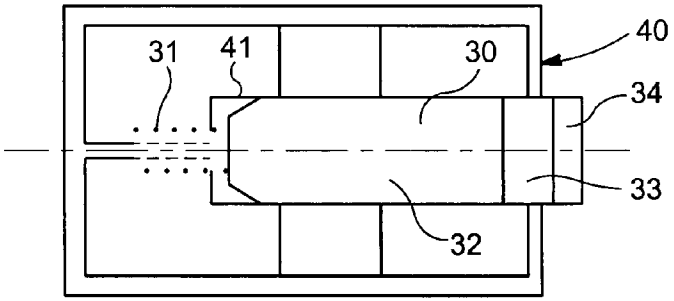
FIG. 9 is a bottom view of a pushbutton and a thrust slider of the extension of FIG. 1.
Figure 10:
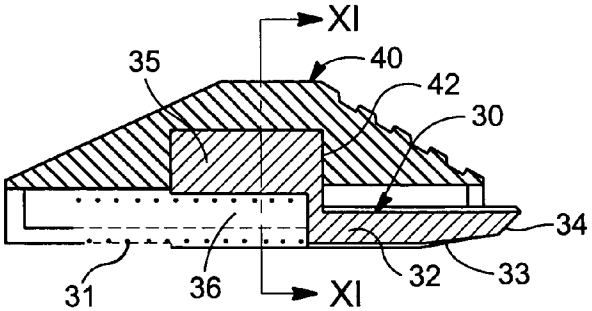
FIG. 10 is a longitudinal sectional view of the pushbutton and the thrust slider of FIG. 9.
Figure 11:
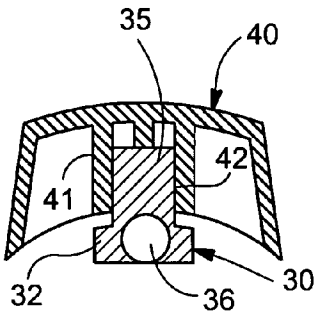
FIG. 11 is a cross-sectional taken view along the plane XI—XI in FIG. 10.
Figure 13:
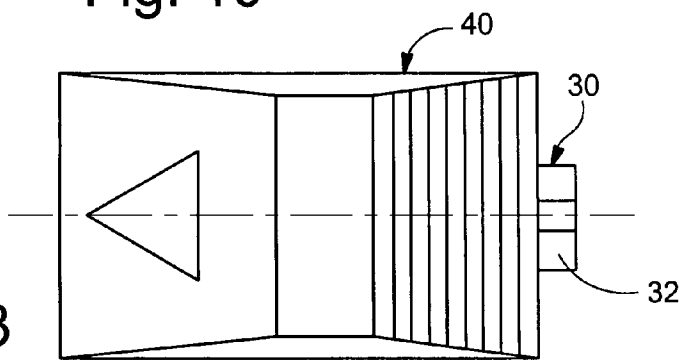
FIGS. 12 and 13 are respectively a right-hand side view and top view of the pushbutton and thrust slider of FIG. 9.
Figure 12:
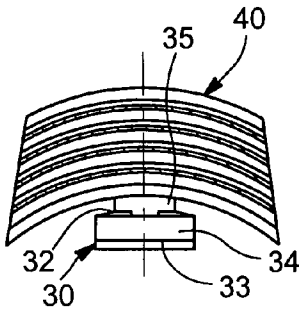

The sleeve 4 has a longitudinal cavity 10 (FIGS. 6–8), an external relief 11, a collar 12 and an internal boss 13 (FIG. 7). The external relief 11 has a substantially parallelepiped shape and is aligned with the cavity 10. The internal boss 13 has a substantially parallelepiped shape and a length nearly the same as that of the sleeve 4.

The cavity 10 has a bottom wall 14 in which an opening 15 is formed. A resilient tongue 16 integral with the sleeve 4 is located in the opening 15. The resilient tongue 16 projects from a wall 18 of the opening 15 and has one end 19 formed as one piece with the wall 18. The resilient tongue 16 has on the upper side an inclined ramp 20 and on the lower side a tooth-shaped projection 21. The resilient tongue 16 is movable radially with respect to the sleeve 4 and, during its centripetal radial movements, causes the projection 21 to penetrate into a recess 7 of the tube 2 (FIG. 1), whereas, during its centrifugal radial movements, it extracts the projection 21 from the recess 7 (FIG. 2). Therefore, the projection 21 forms a means for constraining the inner tube 2 and outer tube 3, the sleeve 4 being made integral with the outer tube 4, as will be illustrated further below, and the resilient tongue 16 forms an appendix of the projection 21.

Figure 4:
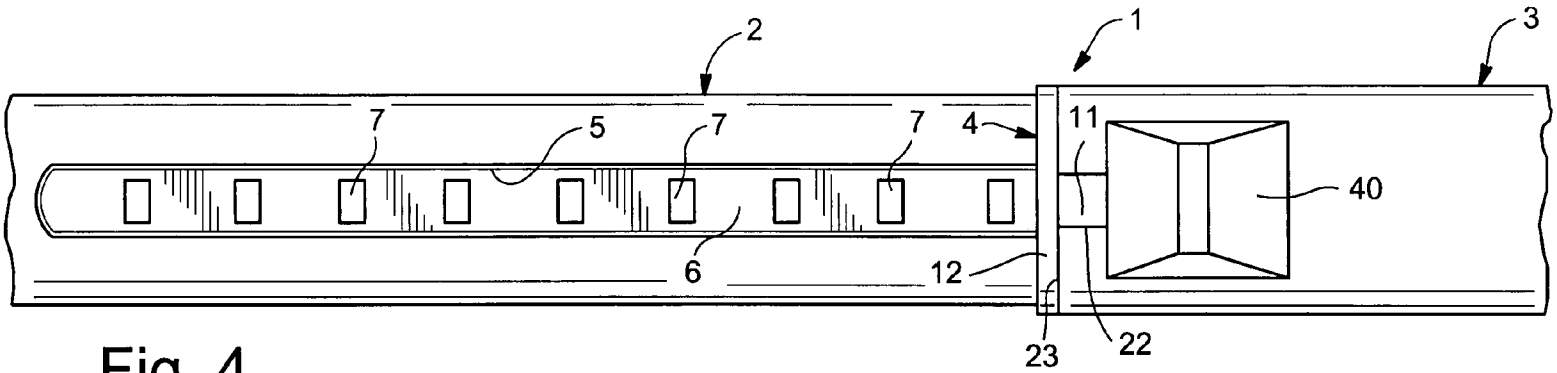
FIG. 4 is a partial top view, on a reduced scale, of the extension of FIG. 1.

The outer tube 3 has a lateral opening 22 which extends as far as one end 23 and engages with the external relief 11 of the sleeve 4 until the end 23 of the outer tube comes into contact against the collar 12 of the sleeve 4 (FIG. 4). Thus the outer tube is coupled with the sleeve 4 and is centred with respect thereto, remaining flush with the collar 12 and with the relief 11 because the latter have a thickness which is practically the same as that of the outer tube 3.

Figure 5:
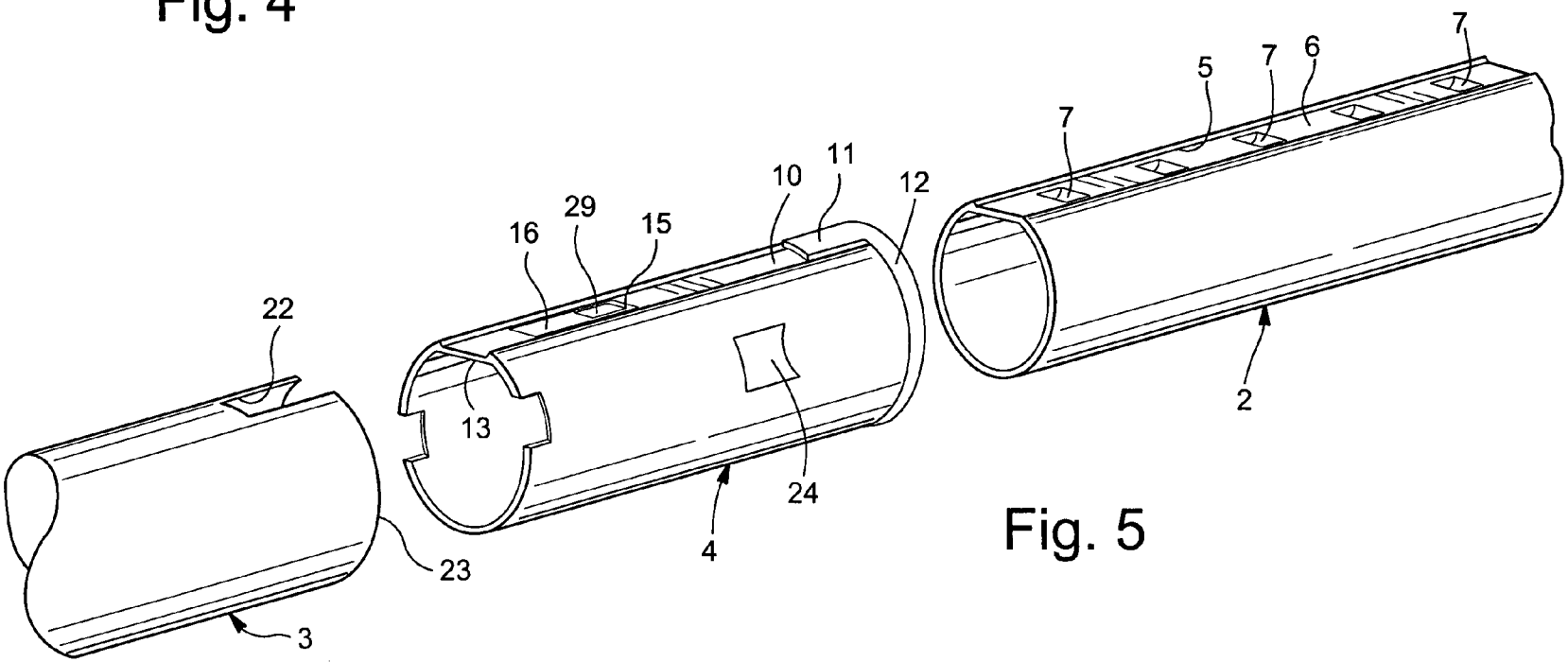
FIG. 5 is a partial, perspective view of an outer tube, a sleeve and an inner tube of the extension of FIG. 1 in the disassembled condition.

The outer tube 3 is fastened to the sleeve 4 by means of two indentations—not shown—which penetrate into two notches 24 on the sleeve 4 (FIGS. 5 and 6). The indentations are formed at the moment of assembly by means of deformation of the wall of the tube 3.

The longitudinal cavity 10 of the sleeve 4 houses a thrust slider 30 and a helical spring 31.

The thrust slider 30 (FIGS. 9–12) consists of a rectangular plate 32 having an inclined wall 33 able to remain in contact with the inclined ramp 20 of the tongue 16, and a tapered wall 34. A head 35 which is formed as one piece with the plate projects upwards from the plate 32. The head 35 and the plate 32 have a blind hole 36 in which the spring 31 is partially housed. The spring 31 reacts against a wall 37 of the cavity 10 in the sleeve 4 and is mounted pre-stressed so that the inclined wall 33 of the slider 30 is normally in contact with the inclined ramp 20 of the resilient tongue 16 (FIG. 1) and pushes the projection 21 to penetrate into a recess 7 of the inner tube 2. In this way, the tubes 2 and 3 are rigidly joined together and form an extension 1 with a predefined length.

A pushbutton 40 (FIGS. 9–13) is mounted on the head 35 of the thrust slider 30 (FIGS. 9–13). The pushbutton 40 has a seat 41 provided with a niche 42 into which the head 35 is inserted with pressure. Thus pushbutton 40 and slider 30 are locked together by means of interference.

The thrust slider 30 and the pushbutton 40 may be formed as one piece.

The tubes 2 and 3 are made, for example, of painted aluminium or stainless-steel sheet metal, which is chrome-plated externally.

The sleeve 4 is made, for example, of a suitable plastic material. The thrust slider 30 and the pushbutton 40 are also made of a suitable plastic material.

The plate 32 of the slider 30 has an elongated and flattened form. It has a thickness practically equal to the depth of the cavity 10 in the sleeve 4. Thus the plate 32 remains embedded inside the cavity 10 and is flush with the external surface of the sleeve 4.

The extension 1 has transverse dimensions which are minimized. Its compact form is also due to the fact that the resilient tongue 16 is provided with the tooth-shaped projection 21 which engages with the indented, concave, recesses 7 of the inner tube 2. The increases in transverse dimensions of the inner tube, which would occur with a tongue which can be engaged with outward projecting protrusions of the inner tube, are thus avoided.

The extension 1, in addition to having a simple and compact design, is also very resistant to stresses because the resilient tongue 16 has a stress resistance much greater than that of a tongue which can be engaged with protrusions projecting from the inner tube and which must have a curved end.

Another advantage of the extension 1 lies in the fact that the contact between the inclined wall 33 of the slider 30 and the inclined ramp 20 of the tongue 16 extends over a surface and any wear which may occur with use of the extension 1 is uniformly distributed over the entire surface. The presence of the spring 31 prevents the formation of play between the slider 30 and the tongue 16 and ensures correct contact also after prolonged use of the extension.

In order to adjust the length of the extension 1, the pushbutton 40 is operated manually, displacing it from the position shown in FIG. 1 to the position shown in FIG. 2 so that the slider 30 separates from the resilient tongue 16 and leaves it free to be raised to extract the projection 21 from the recess 7 of the tube 2, inside which it is inserted.

This allows sliding of the tube 2 inside the tube 3 until the desired length of the extension 1 is achieved.

Assembly of the telescopic extension 1 is performed by fitting the sleeve 4 onto the inner tube 2 so that its internal boss 13 is coupled with the longitudinal groove 5 of the inner tube. The slider 30 with the spring 31 is then mounted in the cavity 10 of the sleeve 4 in a position where its inclined wall 33 is in contact with the ramp 20 of the tongue 16 and pushes the projection 21 into a recess 7 of the inner tube 2.

At this point, the outer tube 3 is fitted onto the sleeve 4, coupling its lateral opening 22 with the external relief 11 until its end 23 is brought into contact against the collar 12 of the sleeve. In this position, the head 35 of the slider 30 projects outside the opening 22 and the pushbutton 40 may be press-fitted thereon. Therefore, the assembly of the extension 1 requires only a few simple and easy operations.

The invention claimed is:

1. A telescopic extension for an electric household appliance, comprising:

a) an inner tube and an outer tube slidable one inside the other, b) a sleeve fastened to said outer tube, c) a constraining means arranged between said inner tube and said outer tube, d) a thrust slider which can be engaged with said constraining means (21) under the action of resilient means, and e) actuating means operationally connected to said thrust slider, f) said inner tube being provided with a row of recesses having a predefined shape, g) said sleeve being arranged between said inner tube and said outer tube, h) said constraining means being movably supported by said sleeve, i) said thrust slider acting on said constraining means under the action of said resilient means to force said constraining means into a recess of said inner tube and lock said inner tube with respect to said outer tube, j) said actuating means being capable of disengaging said thrust slider from said constraining means to leave said constraining means free to move radially and come out of said recess, releasing said inner tube from said outer tube and allowing said inner tube to slide with respect to said outer tube in order to adjust the length of said extension, k) said constraining means having an appendix, l) said appendix comprising a resilient tongue having one end formed as one piece with said sleeve, said resilient tongue being radially movable with respect to said sleeve, m) said constraining means comprising a projection on said resilient tongue, n) said thrust slider can be engaged with said resilient tongue to force said projection into a recess of said inner tube and thus lock said inner and outer tubes and can be disengaged from said resilient tongue to allow said projection to come out of said recess of said inner tube and thus release said inner and outer tubes, said thrust slider being movably supported by said sleeve;

o) said sleeve having a longitudinal cavity able to house said thrust slider and said resilient means, p) the resilient tongue comprises a ramp and the thrust slider comprises a plate with an inclined wall, the ramp and the inclined wall cooperating for forcing the projection into a recess, the plate remaining embedded inside the cavity, being flush with the external surface of the sleeve and being radially constrained by the outer tube, and wherein said outer tube has a lateral opening which extends as far as one end thereof and said sleeve has an external longitudinal relief which engages with said lateral opening to couple said outer tube with said sleeve and center said outer tube with respect to said sleeve.

2. A telescopic extension according to claim 1, wherein said longitudinal cavity has an opening inside which said resilient tongue is located, said one end of said resilient tongue being formed as one piece with a wall of said longitudinal cavity.

3. A telescopic extension according to claim 1, wherein said sleeve has an internal longitudinal boss which is located underneath said longitudinal cavity and said inner tube has a longitudinal groove with which said internal longitudinal boss of said sleeve is coupled in order to centre said sleeve with respect to said inner tube.

4. A telescopic extension according to claim 3, wherein said longitudinal groove of said inner tube has a bottom wall in which said recesses are present.

5. A telescopic extension according to claim 1, wherein said sleeve is provided with a collar against which said one end of said outer tube comes into contact, said collar and said external relief having a thickness substantially equal to that of said outer tube so that it remains flush with said collar and said external relief.

6. A telescopic extension according to claim 1, wherein said thrust slider is provided with an upper head able to be inserted by means of pressure into a niche in said actuating means.

7. A telescopic extension according to claim 1, wherein said sleeve, said resilient tongue and said projection are made of plastic material.

8. A telescopic extension according to claim 1, wherein said outer tube has a cross-section with a substantially constant diameter.

* * * * *